US008322699B2

(12) United States Patent
Prell et al.

(10) Patent No.: US 8,322,699 B2
(45) Date of Patent: Dec. 4, 2012

(54) VISE ASSEMBLY

(75) Inventors: Edward T. Prell, Chicago, IL (US); Charles Hulsey, Naperville, IL (US); Markus Allemann, Grayslake, IL (US)

(73) Assignee: Robert Bosch GmbH, Stuttgart (DE)

( * ) Notice: Subject to any disclaimer, the term of this patent is extended or adjusted under 35 U.S.C. 154(b) by 1123 days.

(21) Appl. No.: 11/492,326

(22) Filed: Jul. 24, 2006

(65) Prior Publication Data

US 2008/0018039 A1 Jan. 24, 2008

(51) Int. Cl.
*B25B 3/00* (2006.01)

(52) U.S. Cl. ..... 269/246; 269/95

(58) Field of Classification Search ..... 269/246, 269/3, 6, 95, 247, 166–169, 71, 73
See application file for complete search history.

(56) References Cited

U.S. PATENT DOCUMENTS

| | | | | | |
|---|---|---|---|---|---|
| 1,333,432 | A | * | 3/1920 | Maier | 269/63 |
| 2,260,995 | A | * | 10/1941 | Kruczek | 403/90 |
| 2,444,727 | A | * | 7/1948 | Bush | 269/72 |
| 2,509,338 | A | | 5/1950 | Elliott et al. | |
| 3,815,892 | A | * | 6/1974 | Tulk | 269/75 |
| 4,140,307 | A | | 2/1979 | Dalmau et al. | |
| 4,502,457 | A | | 3/1985 | Marron | |
| 4,949,945 | A | | 8/1990 | Whiteley | |
| 5,069,433 | A | | 12/1991 | Womack | |
| 5,163,662 | A | | 11/1992 | Bernstein | |
| 5,224,692 | A | * | 7/1993 | Anderson et al. | 269/75 |
| 5,348,276 | A | | 9/1994 | Blacker | |
| 5,401,354 | A | * | 3/1995 | Colucci | 156/580 |
| 5,590,870 | A | * | 1/1997 | Goellner | 269/21 |
| 5,885,036 | A | | 3/1999 | Wheeler | |
| 5,957,445 | A | * | 9/1999 | Hagman et al. | 269/75 |
| 6,361,034 | B1 | * | 3/2002 | Wolfe | 269/8 |
| 6,382,608 | B1 | | 5/2002 | Michell | |
| 6,575,442 | B2 | | 6/2003 | Klimach et al. | |
| 6,591,728 | B1 | | 7/2003 | Grondahl | |
| 6,698,738 | B2 | | 3/2004 | Wiebe | |
| 6,860,475 | B2 | | 3/2005 | Wong | |
| 6,957,808 | B2 | * | 10/2005 | Varzino et al. | 269/95 |
| 7,017,898 | B2 | * | 3/2006 | Varzino et al. | 269/246 |
| 7,066,457 | B2 | * | 6/2006 | Gerritsen et al. | 269/6 |
| 2002/0056353 | A1 | | 5/2002 | Zito | |
| 2003/0214089 | A1 | * | 11/2003 | Duncan | 269/246 |
| 2004/0040127 | A1 | | 3/2004 | Hellkamp | |
| 2005/0082729 | A1 | | 4/2005 | Wong | |
| 2008/0018039 | A1 | * | 1/2008 | Prell et al. | 269/246 |

* cited by examiner

*Primary Examiner* — Lee D Wilson
(74) *Attorney, Agent, or Firm* — Maginot, Moore & Beck

(57) ABSTRACT

An assembly is provided that may be supported on or above a variety of work surfaces and that is adapted to support a workpiece or a tool in a wide range of orientations. The assembly comprises a vise apparatus including (i) a first clamping component, (ii) a second clamping component, and (iii) a slide bar possessing a polygonal-shaped outer surface, the slide bar being at least partially interposed between the first clamping component and the second clamping component. The assembly further includes a first mounting apparatus including (i) a first clamping device configured to engage the polygonal-shaped outer surface of the slide bar so as to releasably hold the slide bar in fixed relation to the first clamping device, and (ii) a first attachment mechanism configured to removably secure the first mounting apparatus to a first support, the first attachment mechanism possessing a first configuration. Moreover, the assembly includes a second mounting apparatus including (i) a second clamping device configured to engage the polygonal-shaped outer surface of the slide bar so as to releasably hold the slide bar in fixed relation to the second clamping device, and (ii) a second attachment mechanism configured to removably secure the second mounting apparatus to a second support, the second attachment mechanism possessing a second configuration which is different from the first configuration.

28 Claims, 10 Drawing Sheets

VISE ASSEMBLY

BACKGROUND

This invention relates to vises or clamping devices used to hold a workpiece and/or a tool. The invention more particularly concerns a multi-function vise assembly adapted to perform a variety of clamping functions in a variety of applications.

Vises and similar clamping devices are of course very well known. Vises have evolved from the hard-mounted industrial vise used in a machine shop to demountable vises used in the home work shop. As the home "do-it-yourselfer" has become more prevalent, so too has the need for vises that can clamp a variety of workpieces in a variety of orientations. As a result, vises have been developed that can be clamped to the edge of a work bench, that are capable of variable two and three-dimensional angular orientations, and that incorporate clamping components.

There remains a need for a truly universal vise assembly that can be configured to clamp a variety of workpieces or tools in a wide range of orientations. This vise apparatus would also be capable of mounting in a number of ways, whether edge mounted or surface mounted.

SUMMARY OF THE INVENTION

In accordance with one embodiment of the present disclosure, there is provided an assembly that comprises a vise apparatus including (i) a first clamping component, (ii) a second clamping component, and (iii) a slide bar possessing a polygonal-shaped outer surface, the slide bar being at least partially interposed between the first clamping component and the second clamping component. The assembly further includes a first mounting apparatus including (i) a first clamping device configured to engage the polygonal-shaped outer surface of the slide bar so as to releasably hold the slide bar in fixed relation to the first clamping device, and (ii) a first attachment mechanism configured to removably secure the first mounting apparatus to a first support, the first attachment mechanism possessing a first configuration. Moreover, the assembly includes a second mounting apparatus including (i) a second clamping device configured to engage the polygonal-shaped outer surface of the slide bar so as to releasably hold the slide bar in fixed relation to the second clamping device, and (ii) a second attachment mechanism configured to removably secure the second mounting apparatus to a second support, the second attachment mechanism possessing a second configuration which is different from the first configuration.

In accordance with another embodiment of the present disclosure, there is provided an assembly that comprises a vise apparatus including (i) an elongated member possessing an outer surface, (ii) a first clamping component attached to a first end portion of the elongated member, and (iii) a second clamping component defining a passage through which the elongated member extends. The assembly further includes a first mounting apparatus including (i) a first clamping device configured to engage the outer surface of the elongated member so as to releasably hold the elongated member in fixed relation to the first clamping device, and (ii) a first attachment mechanism configured to removably secure the first mounting apparatus to a first support, the first attachment mechanism possessing a first configuration. In addition, the assembly includes a second mounting apparatus including (i) a second clamping device configured to engage the outer surface of the elongated member so as to releasably hold the elongated member in fixed relation to the second clamping device, and (ii) a second attachment mechanism configured to removably secure the second mounting apparatus to a second support, the second attachment mechanism possessing a second configuration which is different from the first configuration.

Pursuant to yet another embodiment of the present disclosure, there is provided an assembly that comprises a vise apparatus including (i) a first clamping component, (ii) a second clamping component, and (iii) an elongated member possessing an outer surface, the elongated member being at least partially interposed between the first clamping component and the second clamping component. The assembly also includes a first mounting apparatus including (i) a first clamping device configured to engage the outer surface of the elongated member, (ii) a first attachment mechanism configured to removably secure the first mounting apparatus to a first support, and (iii) a ball and socket clamping assembly interposed between the first clamping device and the first attachment mechanism and configured to releasably secure the first clamping device at any one of a plurality of orientations in relation to the first attachment mechanism. Additionally, the assembly includes a second mounting apparatus including (i) a second clamping device configured to engage the outer surface of the elongated member, (ii) a second attachment mechanism configured to removably secure the second mounting apparatus to a second support, and (iii) a frame structure interposed between the second clamping device and the second attachment mechanism and configured to secure the second clamping device at a predetermined orientation in relation to the second attachment mechanism.

DESCRIPTION OF THE PREFERRED EMBODIMENTS

Figure 1:
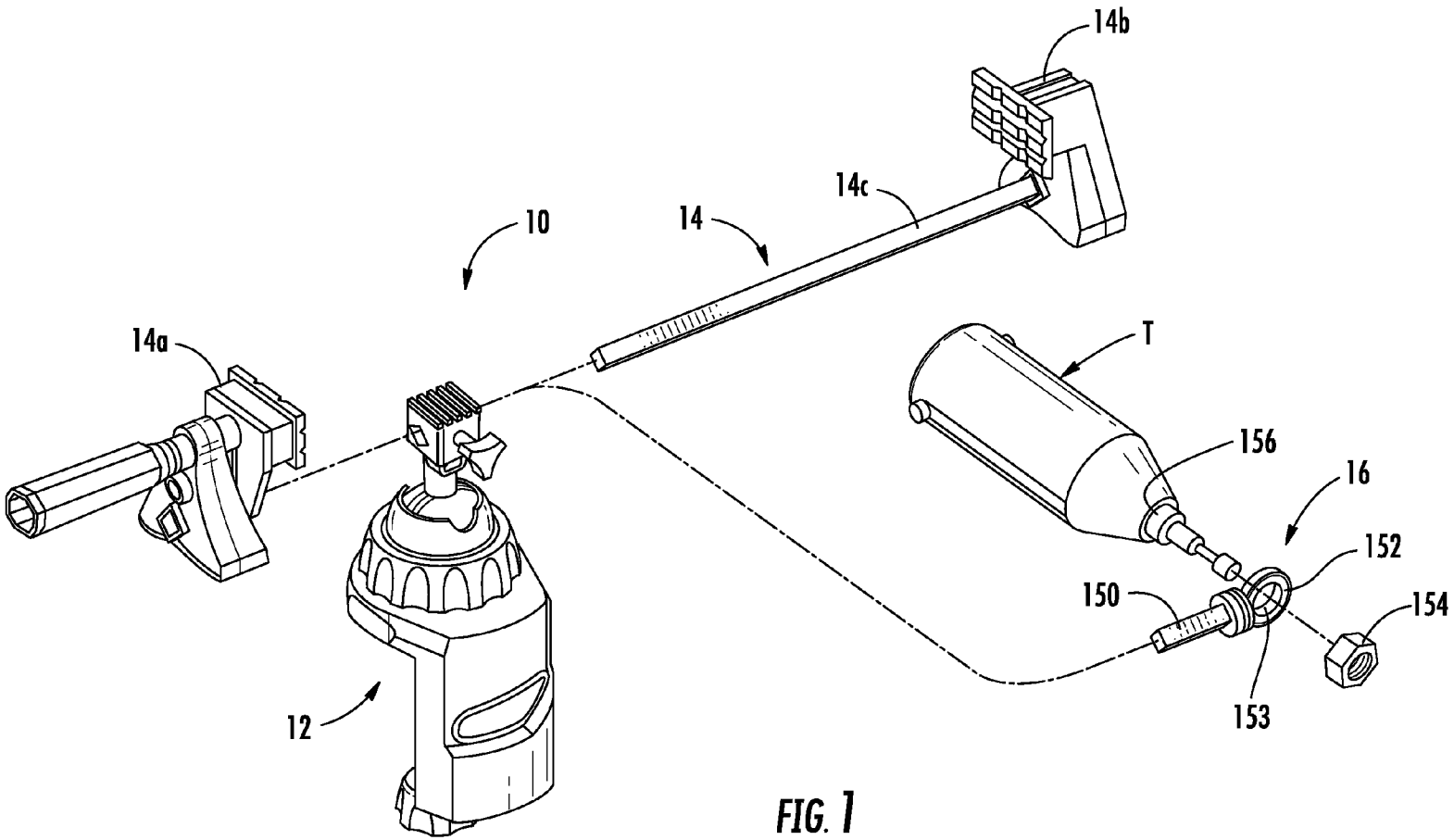
FIG. 1 is an exploded perspective view of components of a vise assembly in accordance with one embodiment of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
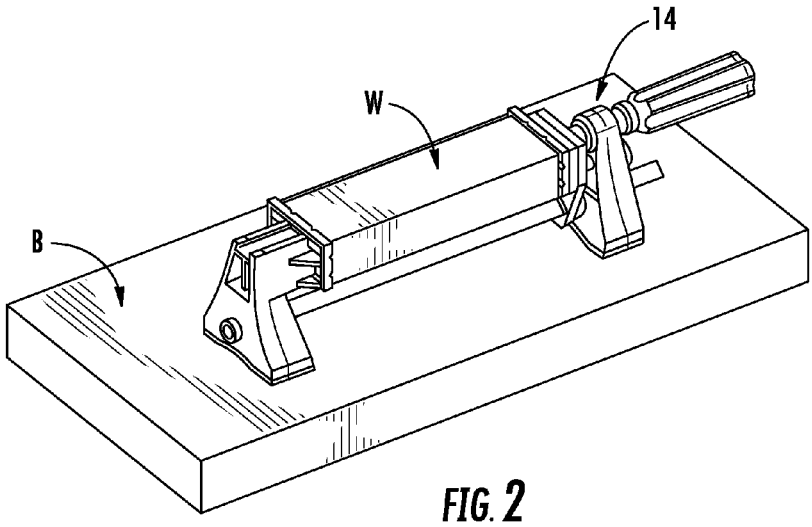
FIG. 2 is a perspective view of components of the vise assembly of FIG. 1 shown in one configuration of the assembly.
Figure 4:
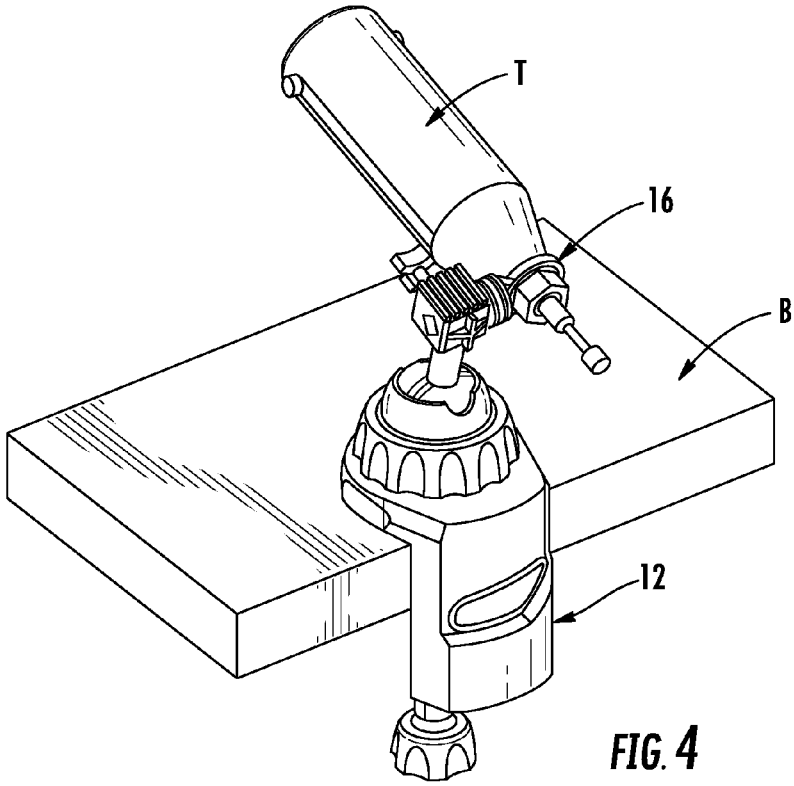
FIG. 4 is a perspective view of components of the vise assembly of FIG. 1 shown in a further configuration of the assembly.
Figure 11:
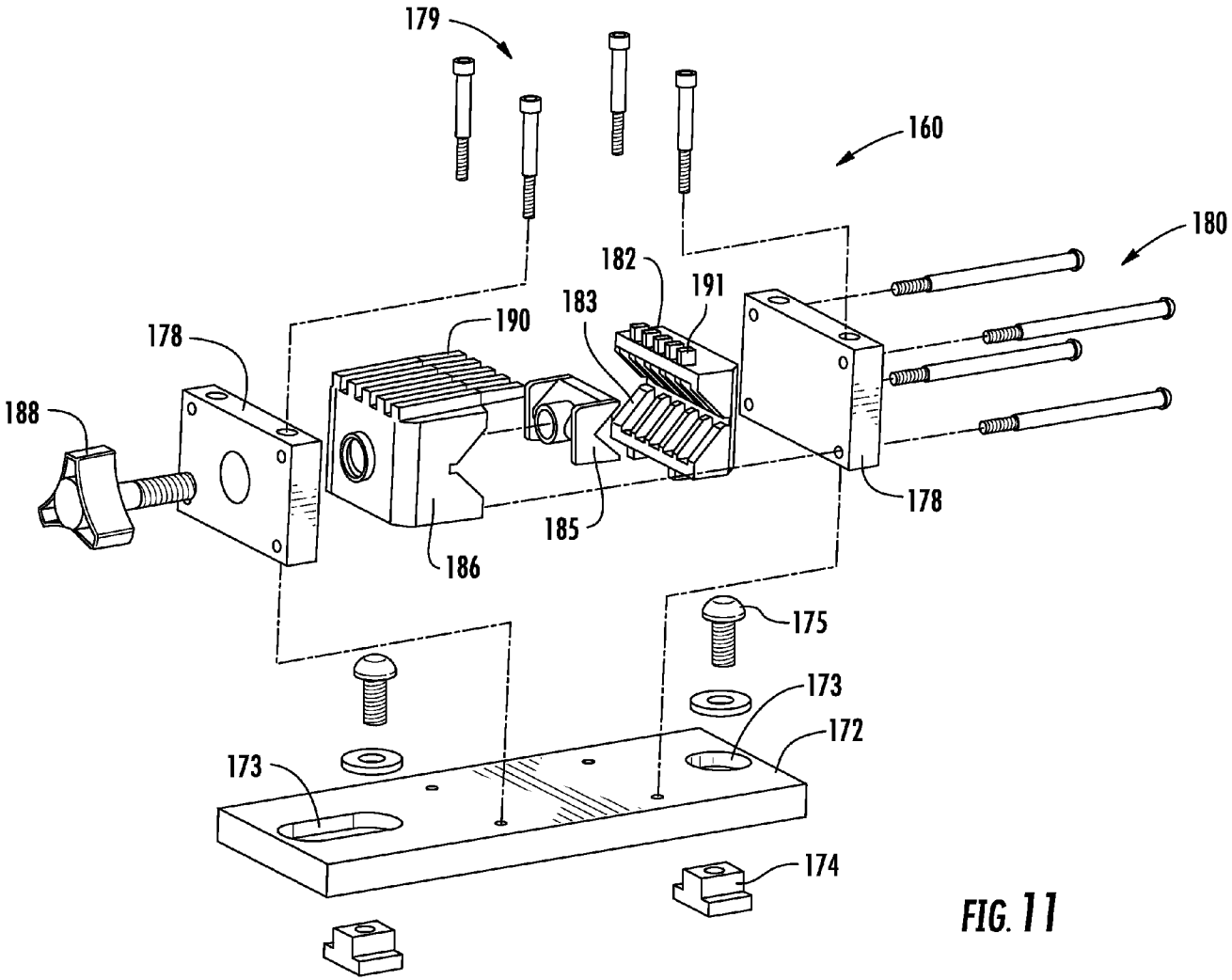
FIG. 11 is an exploded perspective view of the second mounting apparatus of the vise assembly shown in FIG. 1.

An assembly 10, shown in FIG. 1, incorporates multiple components that can be used alone or in combination to clamp a variety of workpieces or tools. In particular, the assembly 10 includes a first mounting apparatus 12 that is configured for edge mounting and supporting other components at variable three-dimensional angles. The assembly 10 further includes a vise apparatus 14 operable to support a workpiece W as shown in FIG. 2. Moreover, the assembly 10 includes a second mounting apparatus 160 shown in detail in FIGS. 11 and 12. The assembly 10 is further enhanced by a tool holder 16 that is configured to support a tool T as shown in FIGS. 1 and 4.

Figure 3:
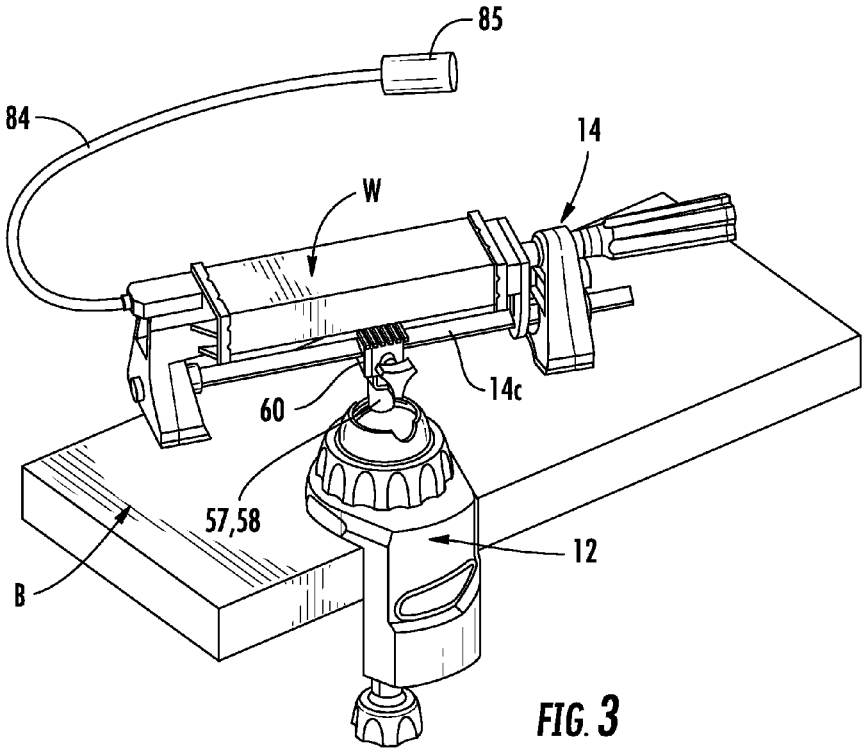
FIG. 3 is a perspective view of components of the vise assembly of FIG. 1 shown in another configuration of the assembly.
Figure 7:
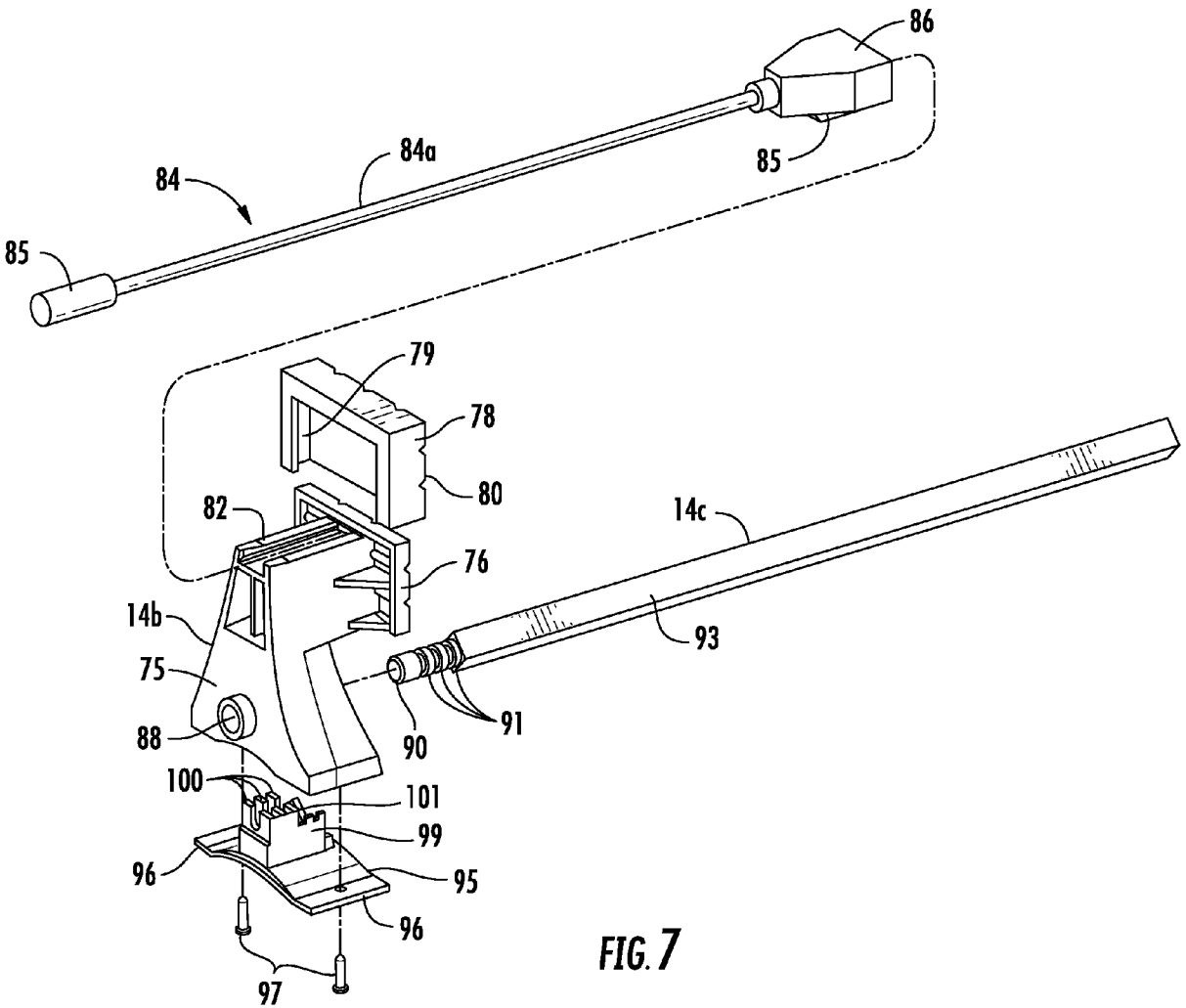
FIG. 7 is an exploded perspective view of a portion of the vise apparatus of the vise assembly shown in FIG. 1.
Figure 12:
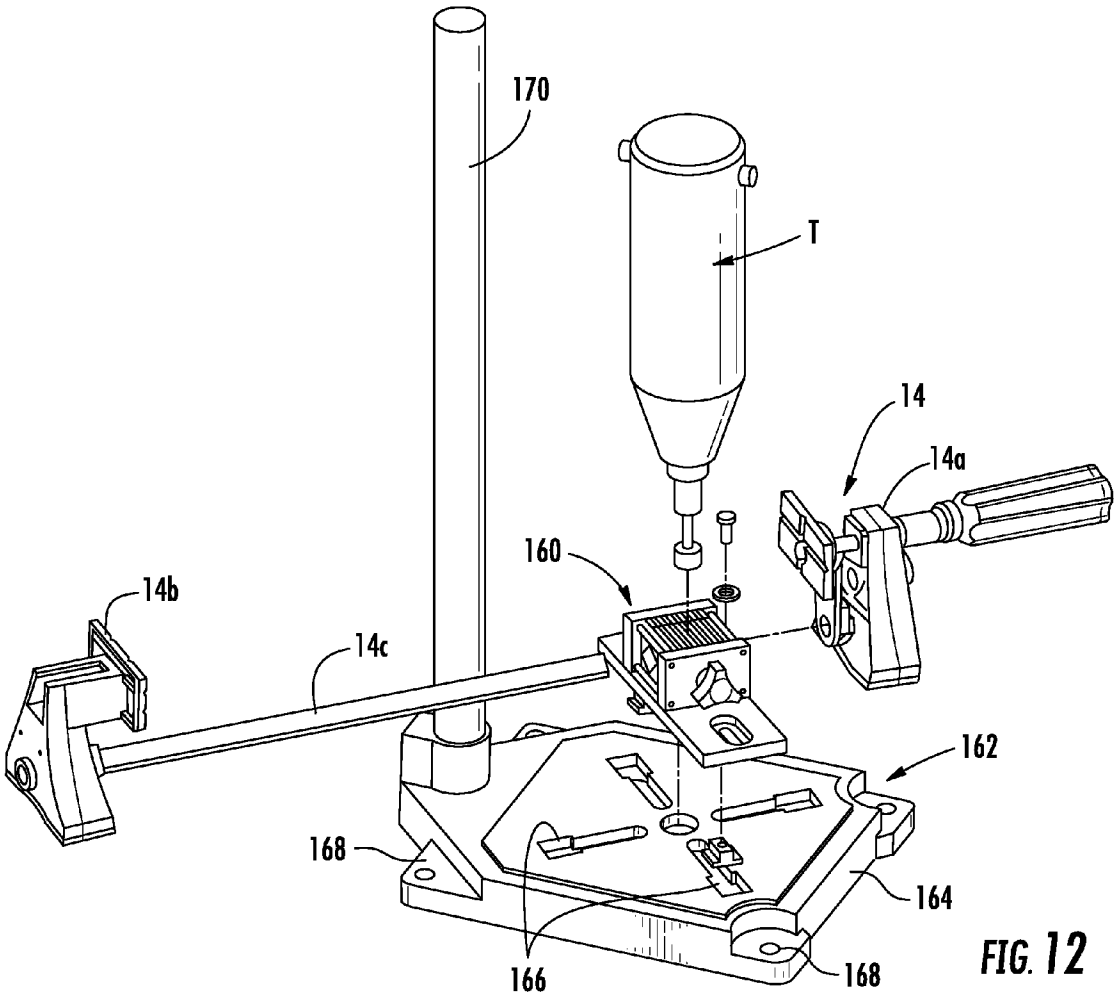
FIG. 12 is an exploded perspective view of the second mounting apparatus of FIG. 11 used with a workstation component for supporting a working tool.

As shown in FIG. 1, the vise apparatus 14 includes a first clamping component 14*a*, a second clamping component 14*b*, and an elongated slide bar 14*c*. The slide bar 14*c* possesses a polygonally-shaped outer surface 93 as shown in FIG. 7. Referring to FIGS. 2-4 and 12, it can be seen that the assembly 10 is capable of use in several applications. For instance, as shown in FIG. 2, the vise apparatus 14 of the assembly 10 may be supported on a work bench B to support a workpiece W. The vise apparatus 14 may be used in conjunction with the first mounting apparatus 12, as shown in FIG. 3 to position the workpiece at different angular orientations relative to the bench B. In FIG. 4, the first mounting apparatus 12 is shown supporting a working tool T at a variable angle relative to the work bench B. In the first application shown in FIG. 2, the vise apparatus 14 simply operates as a traditional vise to grip a workpiece W. In the second application shown in FIG. 3, the first mounting apparatus 12 allows the craftsman to selectively position the workpiece W relative to the work bench B. The assembly 10 also includes a second mounting apparatus 160, as shown in FIG. 12, which allows the vise apparatus 14 to be used in conjunction with a workstation 162 that is itself supported by a work bench (not shown).

Figure 5:
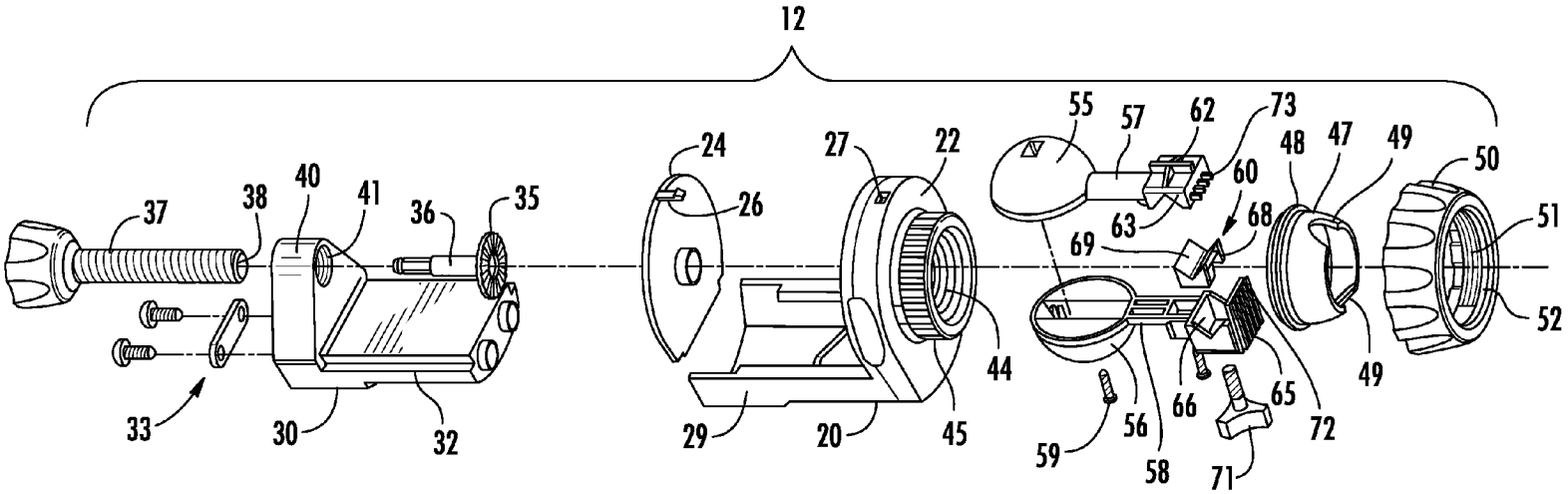
FIG. 5 is an exploded perspective view of the first mounting apparatus of the vise assembly of FIG. 1.

Details of the first mounting apparatus 12 will be explained with reference to FIG. 5. The first mounting apparatus 12 includes a base 20 with a socket body 22 that is adapted to be situated on top of the work bench. The mounting apparatus is provided with a pressure plate 24 that may be removably mounted to the socket body. In one specific embodiment, the pressure plate 24 includes an attachment prong 26 that is advanced into a mating slot 27 defined in the socket body 22. With this feature, the pressure plate may be removed and cleaned or replaced as needed. The pressure plate 24 may be provided with a variety of surface finishes depending upon the work surface to be engaged by the first mounting apparatus 12. In particular, the pressure plate may be provided with a friction enhancing surface treatment. Alternatively, the pressure plate may incorporate surface features adapted to bite into the work surface.

The base 20 further defines a channel section 29 that is configured to receive the clamp assembly 30 of the first mounting apparatus 12. The clamp assembly 30 includes a body 32 that is configured to fit within the channel section 29. Attachment elements 33 are provided to attach the clamp body 32 to the base 20. In the illustrated embodiment, the attachment elements 33 include a backing plate and screws that fit within a recess formed in the clamp body, wherein the screws engage mating bores defined in the base 20. The attachment elements may also help retain the lower edge of the pressure plate 24.

The clamp assembly 30 includes a movable pressure plate 35 that is arranged to engage the underside of the work bench B in a known manner. The movable pressure plate may be provided with an appropriate gripping or friction-enhancing surface. The pressure plate 35 includes a stem 36 that is engaged within a mating bore 38 in an adjustment screw 37. The adjustment screw 37 includes external threads that are engaged within a threaded bore 41 defined in an upstanding flange 40 connected to the clamp body 32. It can be appreciated that the adjustment screw 37 may be manually rotated to advance the screw, and consequently the pressure plate 35, toward the work bench to sandwich the work bench between the two pressure plates 24 and 35. The features of the first mounting apparatus 12 as just described allow it to be fastened to the edge of a work bench, as shown in FIGS. 3 and 4.

The first mounting apparatus 12 further comprises a ball and socket arrangement. In particular, the socket body 22 defines a lower socket portion 44. This portion 44 may include a truncated spherical surface, or may incorporate stepped surfaces. The socket body 22 further defines external threads 45 about the lower socket portion 44. The upper portion of the socket is formed by a socket insert 47. The insert 47 includes an engagement rim 48 that is configured to contact a corresponding rim 52 defined on the interior of a clamping nut 50. The clamping nut includes internal threads 51 for engaging the threads 45 of the lower socket portion 44.

The first mounting apparatus 12 further includes a ball element that is formed by combining two ball halves 55 and 56. Each ball half includes an integral stem 57, 58. Recessed attachment elements 59 (only one element 59 is shown in FIG. 5) may be used to fasten the two halves 55, 56 together. The ends of the stem halves 57, 58 form a clamping device 60. In particular, one of the stem halves 57 defines a head half 62 with a brake surface 63. The brake surface is configured to mate with the exterior surface 93 (FIG. 7) of the slide bar 14*c*. In one embodiment, the slide bar 14*c* possesses a generally square-shaped outer surface as shown in FIG. 7 (i.e. the slide bar 14*c*, when viewed in cross-section, defines a square shape), and the brake surface 63 is preferably configured complementary thereto thereby forming two right angle surfaces.

The opposite stem half 58 defines an opposing head half 65 that has a cavity 66. A brake insert 68 fits within the cavity 66, with its surface 69 opposing the brake surface 63 of the other head half 62. In accordance with one aspect of the clamping device 60, one brake surface, such as surface 63 is relatively fixed, while the other surface, namely brake surface 69 of insert 68, is movable toward the fixed surface. Preferably, the movable brake surface 69 is configured to mate with the exterior surface 93 of the slide bar 14*c*. It can be appreciated that the brake insert 68 may be removed and replaced to accommodate different sizes or configurations of slide bars 14*c*. The movable brake insert 68 is adjusted by way of a clamping screw 71 that is threaded through a bore defined in the head half 65 (not shown), with the tip of the screw 71 bearing against the brake insert 68.

In one embodiment, the head half 65 includes guide fingers 72 extending toward the other head half 62. The head half 62 defines guide ribs 73 that interleave with the guide fingers 72 when the two halves are fastened together. This arrangement provides superior resistance to opening up of the head halves when the slide bar 14*c* is clamped therebetween.

When the first mounting device 12 is assembled, the ball halves 55, 56 are joined using the attachment elements 59, with the movable brake insert 68 disposed between the head halves 62, 65. The adjustment screw 71 may be initially backed off so that adequate space is provided between the brake surface 63 and the brake insert 68 to allow the slide bar 14*c* to be inserted therebetween. The assembled ball component is placed within the lower socket portion 44 with the assembled stem halves 57, 58 extending upward. The socket insert 47 is placed over the assembled ball component and the clamping nut 50 is engaged to the threads 45 of the lower socket portion 44. At least initially, the clamping nut is only loosely tightened a sufficient amount to maintain the ball and socket assembly together. Once the angular orientation of the clamping device 60 has been established, the nut 50 may be fully tightened to clamp the ball component between the socket insert 47 and the lower socket portion 44.

The socket insert 47 may be provided with notches 49 that are sized to receive the combined stem 57, 58 thereby increasing the range of rotation of the combined ball element 55, 56 in relation to the socket body 22. It can thus be appreciated that the first mounting apparatus 12 is extremely flexible and versatile in its use, allowing the craftsman to support a workpiece or tool in a wide range of positions relative to the work bench to which the base is fastened.

Figure 6:
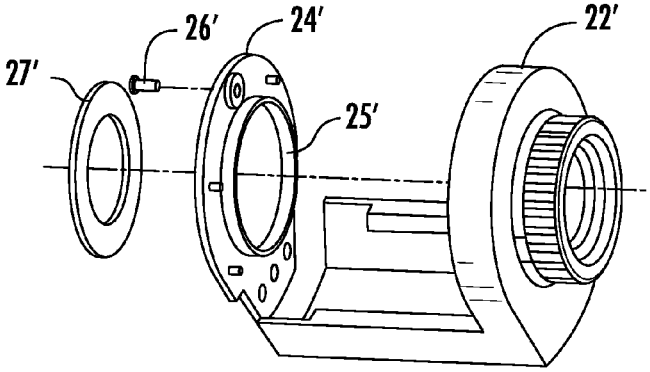
FIG. 6 is a perspective view of an alternative base for use in the first mounting apparatus depicted in FIG. 5.

An alternative configuration for the upper pressure plate of the first mounting apparatus 12 is shown in FIG. 6. In this alternative, the pressure plate 24' defines a central opening 25', thereby reducing the surface area of the pressure plate that contacts the work surface. In some cases, it is desirable to minimize the surface area of contact to avoid unnecessary marring of the work surface. In order to further reduce the potential damage to the work surface, a replaceable cushion disc 27' may be provided that is positioned between the pressure plate 24' and the work surface. In this alternative, the fixation element may incorporate a screw 26' that is threaded into a mating bore defined in the socket body 22'.

Figure 8:
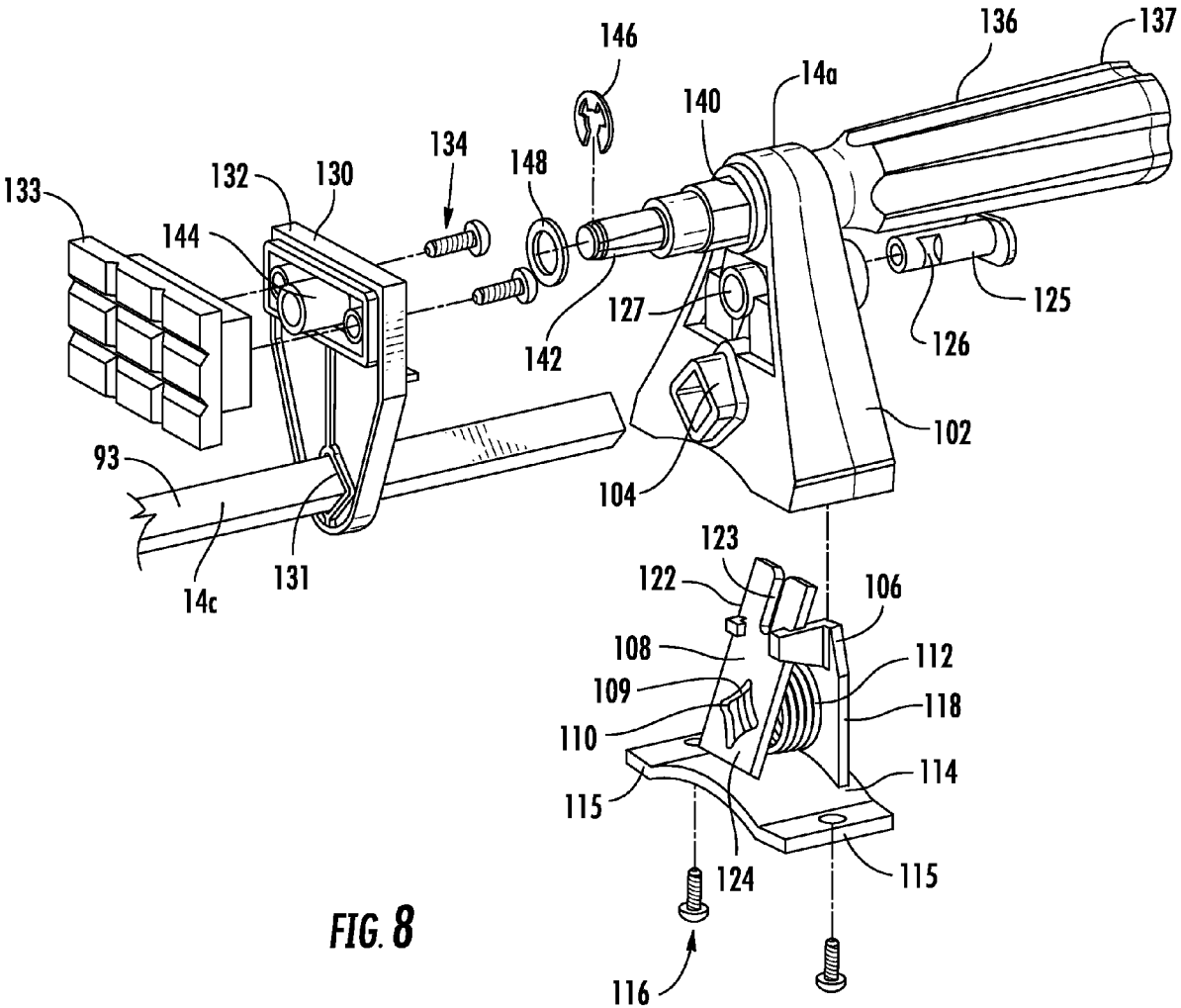
FIG. 8 is an exploded perspective view of another portion of the vise apparatus used in conjunction with the portion shown in FIG. 7.

Details of the vise apparatus 14 can be understood with reference to FIGS. 7-8. The vise apparatus includes the first clamping component 14*a*, the second clamping component 14*b*, and the slide bar 14*c* that is at least partially interposed between the first and second clamping components 14*a*, 14*b* as shown in FIGS. 2 and 3. The second clamping component 14*b*, shown in detail in FIG. 7, includes a vise body 75 with a clamping jaw 76. A jaw attachment 78 may be provided that includes a recess slot 79 that slides over the clamping jaw 76. The jaw attachment has a surface 80 configured to grip a workpiece W, as shown in FIGS. 2-3. It is contemplated that a number of replacement jaw attachments 78 may be provided, each with a different gripping surface 80 for clamping a variety of workpieces having different configurations.

In one embodiment, the body 75 defines a dovetail receptacle 82, preferably on the top of the body. The receptacle is configured to mate with a complementary dovetail mount 85*a* formed on a body 86 of an attachment 84. In one specific embodiment, the attachment 84 includes a bendable shaft 84*a* that can be bent to orient a light source 85 above the workpiece W, as shown in FIG. 3. The power supply and control elements for the light source may be housed in the body 86 that is mounted on the dovetail receptacle 82. Other accessories may be provided that can be supported on the second clamping component 14*b*. Although the first clamping component 14*a* is not shown with a similar mounting receptacle, the same dovetail feature may be incorporated into the first clamping component.

Returning to FIG. 7, the vise body 75 of the second clamping component 14*b* includes a stem bore 88 that is sized to receive a stem 90 of the bar 14*c*. The stem may include notches 91 that are used to fix the slide bar 14*c* against axial movement relative to the body 75. Thus, in one embodiment, the vise body 75 includes a bottom cover 95 with feet 96 for supporting the body on a work bench. The bottom cover 95 includes attachment elements 97 that are used to fix the cover to the base at the hollow underside of the vise body 75. Extending from the bottom cover is a hub 99 that defines a series of recesses corresponding to the notches 91 in the bar 14*c*. Thus, the stem 90, notches, hub 99 and recesses 100 interlock to fix the bar axially relative to the bottom cover 95 and ultimately relative to the second clamping component 14*b*. The hub 99 may further define an opening 101 that is configured to accept the outer surface 93 of the slide bar 14*c*. In the illustrated embodiment, the bar 14*c* has a square cross-sectional outer surface, and the opening 101 will be formed by a surface forming a right angle. The opening 101 being so configured therefore holds the bar 14*c* against rotation.

Figure 7A:
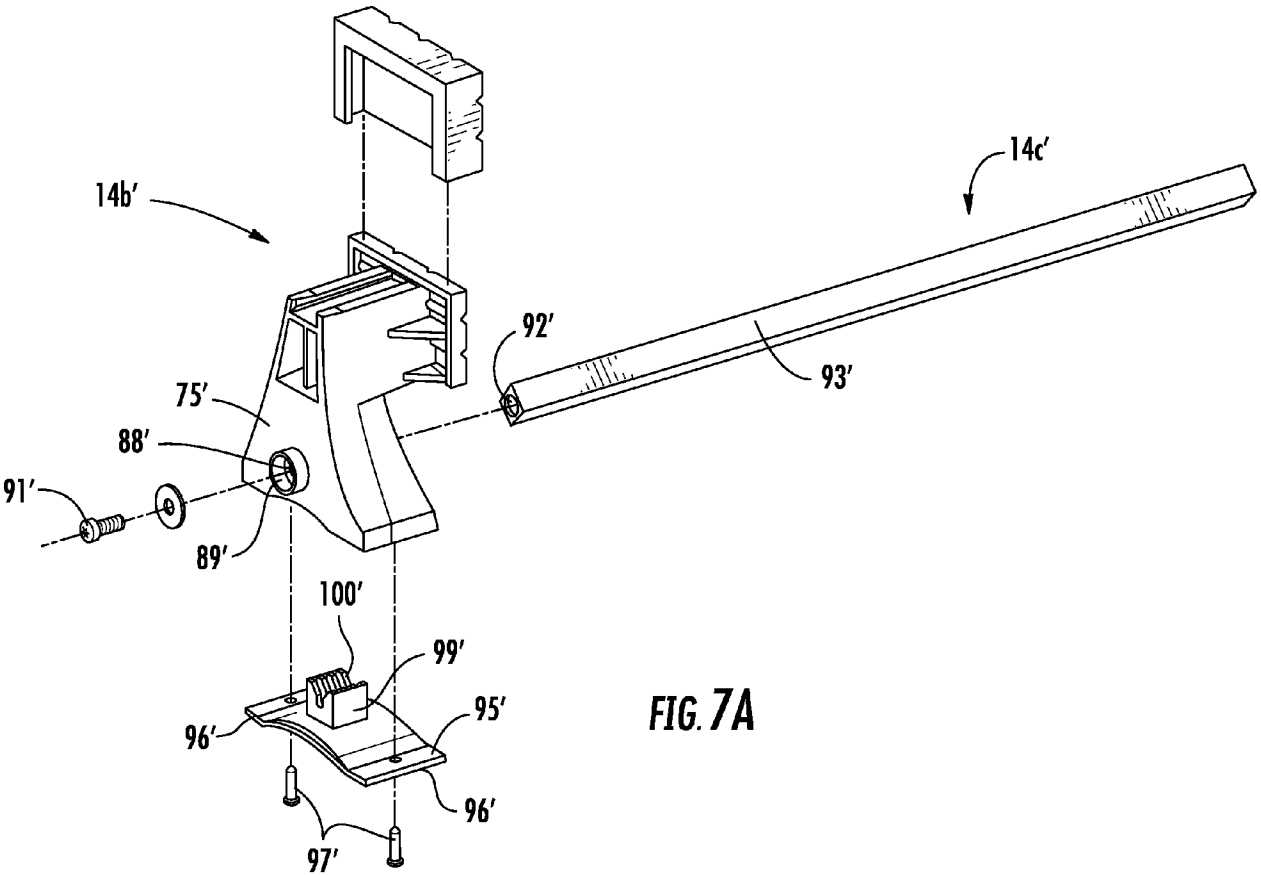
FIG. 7A is an exploded perspective view of an alternative embodiment of the portion of the vise apparatus of the vise assembly shown in FIG. 1.

An alternative second clamping component 14*b'* and alternative elongated slide bar 14*c'* is shown in FIG. 7A. The second clamping component 14*b'* includes A vise body 75' that defines a bore 88' and a fastener space 89'. A fastener 91' extends through the bore 88' to meshingly engage a threaded bore 92' defined in an end portion of the slide bar 14*c'* so as to secure the slide bar 14*c'* to the second clamping component 14*b'*. When so secured together, a head of the fastener 91' is located in the fastener space 89' defined by the vise body 75'. The vise body 75' includes a bottom cover 95' having feet 96' for supporting the body on a work bench. The bottom cover 95' includes attachment elements 97' that are used to fix the cover to the base at the underside of the vise body 75'. Extending from the bottom cover is a hub 99' that includes a series of ribs 100' that are each configured to possess an L-shaped support surface. As shown in FIG. 7A, the slide bar 14*c'* possesses a square-shaped outer surface 93'. Since the square-shaped outer surface 93' of the slide bar 14*c'* rests upon the L-shaped support surfaces of the ribs 100' after the slide bar 14*c'* is secured to the second clamping component 14*b'* with the fastener 91', rotation of the slide bar 14*c'* in relation to the second clamping component 14*b'* is prevented. Note that rotation of slide bar 14*c'* is further prevented by the structure of the vise body 75' which defines a square shaped opening (not shown) through which an end portion of the slide bar 14*c'* extends.

Figure 9:
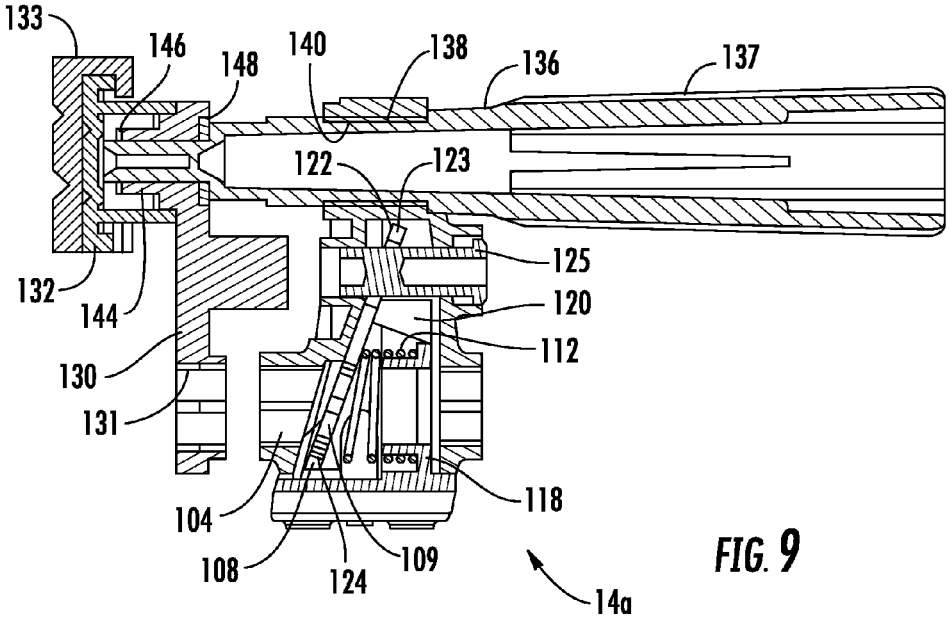
FIG. 9 is a cross-sectional view of the portion of the vise apparatus illustrated in FIG. 8.

The first clamping component 14*a* includes a base 102, as shown in FIGS. 8-9. The base defines a polygonally-shaped opening 104 through which the bar 14*c* is extendable. Preferably, the polygonally-shaped opening 104 is a rectangularly-shaped opening. As previously explained, the polygonally-shaped opening holds the bar 14*c* against axial rotation relative to the base 102. An end portion of the bar 14*c* extends through the opening 104 and through a hollow interior of the base 102 (FIGS. 2 and 3). A locking mechanism is disposed within the hollow interior of the base 102. The locking mechanism is operable to fix the position of the first clamping component 14*a* relative to the slide bar 14*c*. Thus, in one embodiment, the base 102 includes a locking plate 108 that defines a locking opening 109 that is shaped generally complementary to the exterior surface 93 of the bar 14*c*. Thus, in the illustrated embodiment, the opening 109 possesses a square shape configured generally complementary to the square-shaped outer surface of the bar. The opening 109 includes corner reliefs 110 so that the bar may be easily inserted through the locking opening 109. It is contemplated that the opening 109 is slightly larger than the outer surface 93 of the bar to facilitate introduction of the bar through the opening.

The locking plate is confined between the bottom cover 114 and the interior structure of the base 102. The bottom cover includes feet 115 that are adapted to be supported on a work surface. Attachment elements 116 fasten the cover to the base to contain the locking plate 108 within the hollow base. A support plate 118 extends from the bottom cover and is configured to support a biasing element 112 that bears against the locking plate 108. In one embodiment, the biasing element is a compression spring.

The locking plate 108 is free to pivot within the hollow base 102 against the spring bias of the biasing element 112 from the angled position shown in FIG. 9 to a substantially vertical orientation (not shown) upon application of external force to the locking plate. The biasing element 112 biases the locking plate 108 to the angled locking position. In order to achieve the locking and release positions, the upper end 122 of the locking plate 108 is pivotably supported within the hollow interior of the base 102, as best seen in FIG. 9. The upper end 122 of the locking plate 108 defines a slot 123 which receives an end portion of the release button 125. The release button 125 defines a notch 126 that receives the upper end 122 of the locking plate 108 therein. The release button is slidably disposed within a bore 127 in the base 102. With the upper end 122 of the locking plate 108 engaged with the end portion of the release button 125 as described above, depressing the release button 125 pushes the upper end 122 of the locking plate 108. Interaction between the locking plate 108 and a pivot structure of the base 102 causes the lower portion 124 of the locking plate to pivot against the action of the biasing element 112 toward its vertical release position. In this position, the locking opening 109 is aligned with the bar so that the bar 14*c* may be readily removed from the base 102.

Note that when no force is being applied to the release button 125, the first clamping component 14*a* may still be slid over the bar 14*c* to bring the first clamping component 14*a* toward the second clamping component 14*b*. However, the opposite is not true. Indeed, when no force is being applied to the release button 125, the locking mechanism prevents the first clamping component 14*a* from being slid over the bar 14*c* to advance the first clamping component 14*a* away from the second clamping component 14*b*. The reason for this operation is as follows. When slide bar 14*c* is being inserted through the opening 104 defined in the base 102, the slide bar pushes against the locking plate 108 so as to compress the biasing element 112 and move the locking plate into a more vertical orientation. Movement to a more vertical orientation increases the vertical profile of the locking opening 109 to a point in which the slide bar 14*c* is able to be continuously advanced therethrough. In contrast, when the slide bar 14*c* is attempted to be advanced out of the opening 104 in the direction opposite to that described above, the slide bar urges the locking plate 108 toward a more angled, locked position thereby causing the edge structure of the locking plate 108 that defines the locking opening 109 to dig into the slide bar 14*c*.

The craftsman may easily adjust the location of the first clamping component 14*a* relative to the second clamping component 14*b* along the bar 14*c* by depressing the release button 125 while sliding the base 102 along the bar. Once the base is at the desired distance from the second clamping component 14*b*, manual pressure on the button may be removed and the biasing element 112 will force the locking plate 108 into its angled locking position. As the locking plate pivots to the locking position, the top end 122 of the plate will return the release button 125 to its initial position for easy access.

It is contemplated in certain embodiments that the final clamping position of the clamping components 14*a*, 14*b* may be established only by manipulation of the locking plate 108. However, in a preferred embodiment, the locking plate is used to achieve a rough initial positioning of the first clamping component 14*a*. The final clamping may be effected by a movable backing plate 130, as shown in FIGS. 8-9. The lower end of the backing plate defines a contoured opening 131 that is sized to slidingly receive the bar 14*c* therethrough. The backing plate includes a mounting head 132 for receiving a removable jaw attachment 133. The jaw attachment 133 may be configured like the attachment 78 of the second clamping component 14*b*. Alternatively, the jaw attachment 133 may be fixed to the mounting head 132 by attachment elements 134.

An adjustment screw 136 is provided that is operable to move the backing plate 130 relative to the base 102. The adjustment screw includes a handle 137 that is configured to be manually rotated by the craftsman. External threads 138 on the adjustment screw 136 mate with threads in the adjustment screw bore 140 in the base 102. Thus, rotation of the adjustment screw causes the adjustment screw stem 142 to move toward or away from the base 102.

The backing plate 130 is connected to the stem 142 so that the plate moves with the stem along the bar 14*c*. In one embodiment, the stem 142 extends into a stem bore 144 defined in the mounting head 132 (FIG. 9). A retaining ring 146 at the distal end of the stem locks the stem within the bore 144. A thrust washer 148 may be provided at the other end of the stem to absorb thrust forces from the backing plate as the vise jaw attachment 133 is clamped onto a workpiece.

Figure 10:
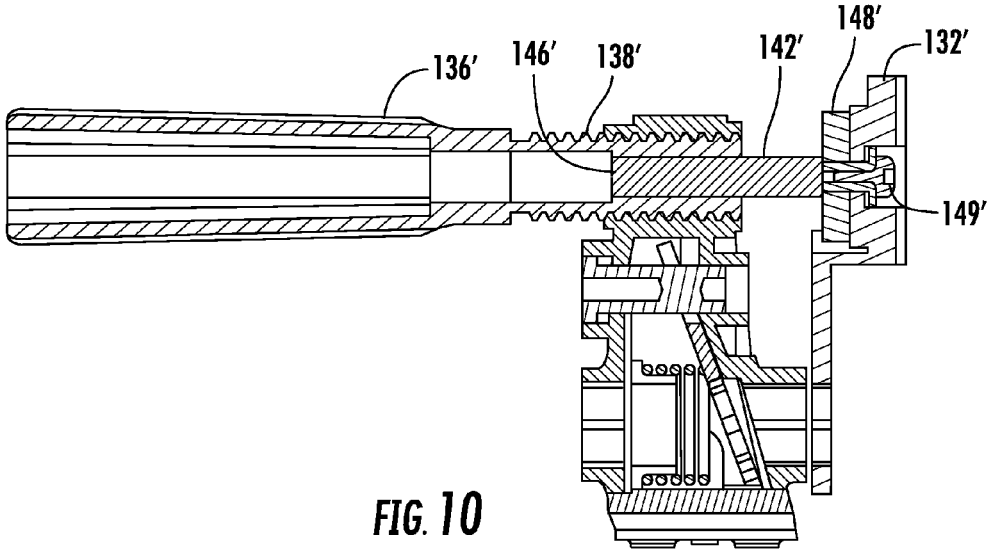
FIG. 10 is a cross-sectional view of an alternative version of the portion of the vise apparatus illustrated in FIG. 8.

In the embodiment of FIGS. 8-9, the stem 142 is integral with the remainder of the adjustment screw 136. In an alternative embodiment, shown in FIG. 10, the adjustment screw 136' includes external threads 138' for engagement within the adjustment screw bore 140. The adjustment screw stem 142' is separate from the remainder of the adjustment screw and is fastened by way of a suitable fastener or retaining ring 146'. The adjustment screw stem is fastened to a modified mounting head 132' by way of a clamping screw 149'. A thrust washer 148' may be disposed between the end of the adjustment screw 136' and the backing plate mounting head 132'.

The vise apparatus 14 may be supported on a work bench B, as shown in FIG. 2, or may be supported by the first mounting apparatus 12, as shown in FIG. 3. In the latter case, the bar 14*c* is engaged within the clamping device 60 of the first mounting apparatus 12. As shown in FIG. 3, the vise apparatus 14 is essentially elevated above the work bench B by the first mounting apparatus 12. It can be appreciated that the stem 57, 58 may be shifted to different angles while the clamping device 60 supports the vise apparatus 14 until the workpiece W supported thereby is at a desired position. Once the workpiece is properly oriented, the clamping nut 50 of the first mounting apparatus 12 may be tightened to fix the angular orientation of the stem 57, 58 and clamping device 60.

It is also contemplated that the vise apparatus 14 may be supported on a work station, such as the work station 162 depicted in FIG. 12. One work station 162 includes a base 164 that has mounting flanges 168 for mounting the station to a work surface. A post 170 extends substantially vertically from the base 164. The post is adapted to support fixtures for carrying a tool T, and more particularly for supporting the tool above a workpiece held to the workstation base. In this embodiment, the workpiece may be held by the vise apparatus 14. In order to integrate the vise apparatus 14 with the work station 162, a second mounting apparatus 160 is provided as shown in detail in FIG. 11. The second mounting apparatus 160 includes an adaptor plate 172 with slots 173 for receiving a T-nut 174 and attachment screw 175 therethrough. The T-nut is configured to fit within T-slots 166 formed in the work station case 164. As shown in FIG. 12, two sets of T-slots are arranged perpendicular to each other so that the adaptor plate 172 may be placed at two different positions. The adaptor plate 172 carries opposing support plates 178 that are preferably fastened to the plate by screws 180. Screws 180 may span laterally between the two plates providing a firm foundation for clamping between the plates. In addition, the lateral screws 180 form a sort of cage for containing the sliding movement of the clamping elements.

In the illustrated embodiment, the clamping elements include a bar holder 182 with a clamping surface 183 that is configured to mate with the external surface 93 of the bar 14*c*. A movable support body 186 carries a clamp insert 185 that also includes a contoured clamping surface. Thus, the bar 14*c* is clamped between the clamp insert 185 and the bar holder 182. An adjustment screw 188 passes through one of the end plates 178 and advances or retracts the movable support body 186 as the screw is rotated. Like the clamping device 60, the two brake elements are interlocked when fingers 190 and ribs 191 are interleaved.

As shown in FIG. 12, the second mounting apparatus 160 may be fastened to a work station 162. In addition, the bar 14*c* may be clamped between the bar holder 182 and clamp insert 185. With the bar 14*c* in position on the work station 162, the first clamping component 14*a* of the vise apparatus 14 may be added and used to clamp a workpiece beneath the working tool T.

In addition to supporting the vise apparatus 14, the first mounting apparatus 12 may be used alone to support a tool, as shown in FIG. 4. A tool holder 16, shown in FIG. 1, may be provided that includes a post 150 having a polygonally-shaped outer surface which matches the outer surface of the bar 14*c* so as to enable the post 150 to be securely clamped within the clamping device 60 of the first mounting apparatus 12. An eyelet 152 is provided at the end of the post 150, with an opening 153 sized to receive the working end and hub 156 of the tool T. A nut 154 mates with threads on the hub 156 of the tool and is used to tighten the tool T onto the tool holder 16. It can be appreciated that the post 150 of the tool holder 16 may be positioned with the eyelet opening 153 oriented either vertically or horizontally. The angular position of the holder and the tool T may then be adjusted by moving the swivel ball 55, 56 relative to the body 32 of the first mounting apparatus 12.

It is understood that the dimensions of the components of the assembly 10 may be adjusted depending upon the size of workpieces to be clamped and the type and dimensions of the work surfaces on which the system is supported. For instance, the first mounting apparatus 12 may be sized to be clamped onto a work table having a thickness ranging from ¾ to 2½ inches. The vise apparatus 14 may be configured to have a maximum jaw opening of 7¼ inches. The post 150 of the tool holder 16 may have a length of 2 inches. The combined stem 57, 58 of the first mounting apparatus 12 may be sized to elevate the clamping device 60 1-1½ inches above the swivel insert 47.

As described above, the first mounting apparatus 12 includes an attachment mechanism configured to removably secure the first mounting apparatus 12 to a support (i.e. the workbench B shown in FIG. 3). This attachment mechanism is shown in detail in FIG. 5 and includes, among other components, the adjustment screw 37, body 32, channel section 29, socket body 22, ball halves 55, 56, socket insert 47, and clamping nut 50. Also as described above, the second mounting apparatus 160 includes an attachment mechanism configured to removably secure the second mounting apparatus 160 to a support (i.e. the workstation 162 shown in FIG. 12). This attachment mechanism is shown in detail in FIG. 11 and includes, among other components, adaptor plate 172, T-nuts 174, and support plates 178. It should be appreciated that the type of mechanical components utilized in the respective attachment mechanisms are distinguishable from each other, and the way the respective attachment mechanisms operate to secure the respective mounting apparatus to the respective supports is distinguishable in relation to each other.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. An assembly, comprising:

a vise apparatus including (i) a first clamping component, (ii) a second clamping component, and (iii) a slide bar possessing a polygonal-shaped outer surface, said slide bar being at least partially interposed between said first clamping component and said second clamping component;

a first mounting apparatus including (i) a first clamping device configured to engage said polygonal-shaped outer surface of said slide bar so as to releasably hold said slide bar in fixed relation to said first clamping device, and (ii) a first attachment mechanism configured to readily removably secure said first mounting apparatus to a first support, said first attachment mechanism possessing a first configuration; and a second mounting apparatus including (i) a second clamping device configured to engage said polygonal-shaped outer surface of said slide bar so as to releasably hold said slide bar in fixed relation to said second clamping device, and (ii) a second attachment mechanism configured to readily removably secure said second mounting apparatus to a second support, said second attachment mechanism possessing a second configuration which is different from said first configuration, wherein said first configuration of said first attachment mechanism is characterized by said first attachment mechanism including (i) a generally C-shaped structure that defines a contact surface and an internally threaded bore that is spaced apart from said contact surface, and (ii) an externally threaded adjustment screw meshingly received within said internally threaded bore, said adjustment screw being movable in relation to said contact surface in response to rotation of said adjustment screw, and wherein said second configuration of said second attachment mechanism is characterized by said second attachment mechanism including (i) a plate that has an opening defined therein, (ii) an externally threaded fastener configured to extend through said opening, and (iii) a generally T-shaped nut having an internally threaded bore configured to meshingly receive a portion of said externally threaded fastener therein.

2. An assembly, comprising:

a vise apparatus including (i) a first clamping component, (ii) a second clamping component, and (iii) a slide bar possessing a polygonal-shaped outer surface, said slide bar being at least partially interposed between said first clamping component and said second clamping component;

a first mounting apparatus including (i) a first clamping device configured to engage said polygonal-shaped outer surface of said slide bar so as to releasably hold said slide bar in fixed relation to said first clamping device, and (ii) a first attachment mechanism configured to readily removably secure said first mounting apparatus to a first support, said first attachment mechanism possessing a first configuration; and a second mounting apparatus including (i) a second clamping device configured to engage said polygonal-shaped outer surface of said slide bar so as to releasably hold said slide bar in fixed relation to said second clamping device, and (ii) a second attachment mechanism configured to readily removably secure said second mounting apparatus to a second support, said second attachment mechanism possessing a second configuration which is different from said first configuration, wherein said first clamping component includes a locking mechanism configured to releasably secure said first clamping component to said slide bar at any one of a plurality of positions along the length of said slide bar.

3. The assembly of claim 2, wherein said second clamping component is permanently fixed in relation to said slide bar.

4. An assembly, comprising:

a vise apparatus including (i) a first clamping component, (ii) a second clamping component, and (iii) a slide bar possessing a polygonal-shaped outer surface, said slide bar being at least partially interposed between said first clamping component and said second clamping component;

a first mounting apparatus including (i) a first clamping device configured to engage said polygonal-shaped outer surface of said slide bar so as to releasably hold said slide bar in fixed relation to said first clamping device, and (ii) a first attachment mechanism configured to readily removably secure said first mounting apparatus to a first support, said first attachment mechanism possessing a first configuration; and a second mounting apparatus including (i) a second clamping device configured to engage said polygonal-shaped outer surface of said slide bar so as to releasably hold said slide bar in fixed relation to said second clamping device, and (ii) a second attachment mechanism configured to readily removably secure said second mounting apparatus to a second support, said second attachment mechanism possessing a second configuration which is different from said first configuration, wherein said first clamping device includes a first pair of jaws that cooperate with each other to form a first clamping surface that is shaped complementary to said polygonal-shaped outer surface of said slide bar, and wherein said second clamping device includes a second pair of jaws that cooperate with each other to form a second clamping surface that is shaped complementary to said polygonal-shaped outer surface of said slide bar.

5. An assembly, comprising:

a vise apparatus including (i) a first clamping component, (ii) a second clamping component, and (iii) a slide bar possessing a polygonal-shaped outer surface, said slide bar being at least partially interposed between said first clamping component and said second clamping component;

a first mounting apparatus including (i) a first clamping device configured to engage said polygonal-shaped outer surface of said slide bar so as to releasably hold said slide bar in fixed relation to said first clamping device, and (ii) a first attachment mechanism configured to readily removably secure said first mounting apparatus to a first support, said first attachment mechanism possessing a first configuration; and a second mounting apparatus including (i) a second clamping device configured to engage said polygonal-shaped outer surface of said slide bar so as to releasably hold said slide bar in fixed relation to said second clamping device, and (ii) a second attachment mechanism configured to readily removably secure said second mounting apparatus to a second support, said second attachment mechanism possessing a second configuration which is different from said first configuration, wherein said first clamping component includes a first pedestal portion having a first length and a first width, wherein said second clamping component includes a second pedestal portion having a second length and a second width, wherein said first length of said first clamping component is arranged perpendicular to said slide bar, and wherein said second length of said second clamping component is arranged perpendicular to said slide bar.

6. An assembly, comprising:

a vise apparatus including (i) a first clamping component, (ii) a second clamping component, and (iii) a slide bar possessing a polygonal-shaped outer surface, said slide bar being at least partially interposed between said first clamping component and said second clamping component;

a first mounting apparatus including (i) a first clamping device configured to engage said polygonal-shaped outer surface of said slide bar so as to releasably hold said slide bar in fixed relation to said first clamping device, and (ii) a first attachment mechanism configured to readily removably secure said first mounting apparatus to a first support, said first attachment mechanism possessing a first configuration; and a second mounting apparatus including (i) a second clamping device configured to engage said polygonal-shaped outer surface of said slide bar so as to releasably hold said slide bar in fixed relation to said second clamping device, and (ii) a second attachment mechanism configured to readily removably secure said second mounting apparatus to a second support, said second attachment mechanism possessing a second configuration which is different from said first configuration, wherein said first mounting apparatus further includes a ball and socket clamping assembly interposed between said first clamping device and said first attachment mechanism, and wherein said ball and socket clamping assembly is configured to releasably secure said first clamping device at any one of a plurality of orientations in relation to said first attachment mechanism.

7. The assembly of claim 6, wherein said second mounting apparatus further includes a pair of vertically oriented support members between which said second clamping device is located.

8. An assembly, comprising:

a vise apparatus including (i) a first clamping component, (ii) a second clamping component, and (iii) a slide bar possessing a polygonal-shaped outer surface, said slide bar being at least partially interposed between said first clamping component and said second clamping component;

a first mounting apparatus including (i) a first clamping device configured to engage said polygonal-shaped outer surface of said slide bar so as to releasably hold said slide bar in fixed relation to said first clamping device, and (ii) a first attachment mechanism configured to readily removably secure said first mounting apparatus to a first support, said first attachment mechanism possessing a first configuration; and a second mounting apparatus including (i) a second clamping device configured to engage said polygonal-shaped outer surface of said slide bar so as to releasably hold said slide bar in fixed relation to said second clamping device, and (ii) a second attachment mechanism configured to readily removably secure said second mounting apparatus to a second support, said second attachment mechanism possessing a second configuration which is different from said first configuration; and a tool holder including: (i) an eyelet defining an opening through which a tool may extend; and (ii) a post extending from said eyelet and possessing an outer surface configured to match said polygonal-shaped outer surface of said slide bar.

9. An assembly, comprising:

a vise apparatus including (i) a first clamping component, (ii) a second clamping component, and (iii) a slide bar possessing a polygonal-shaped outer surface, said slide bar being at least partially interposed between said first clamping component and said second clamping component;

a first mounting apparatus including (i) a first clamping device configured to engage said polygonal-shaped outer surface of said slide bar so as to releasably hold said slide bar in fixed relation to said first clamping device, and (ii) a first attachment mechanism configured to readily removably secure said first mounting apparatus to a first support, said first attachment mechanism possessing a first configuration; and a second mounting apparatus including (i) a second clamping device configured to engage said polygonal-shaped outer surface of said slide bar so as to releasably hold said slide bar in fixed relation to said second clamping device, and (ii) a second attachment mechanism configured to readily removably secure said second mounting apparatus to a second support, said second attachment mechanism possessing a second configuration which is different from said first configuration, wherein said polygonal-shaped outer surface of said slide bar is a rectangular-shaped outer surface.

10. The assembly of claim 6, wherein said second mounting apparatus further includes a frame structure interposed between said second clamping device and said second attachment mechanism and configured to secure said second clamping device at a predetermined orientation in relation to said second attachment mechanism.

11. An assembly, comprising:

a vise apparatus including (i) an elongated member possessing an outer surface, (ii) a first clamping component attached to a first end portion of said elongated member, and (iii) a second clamping component defining a passage through which said elongated member extends;

a first mounting apparatus including (i) a first clamping device configured to engage said outer surface of said elongated member so as to releasably hold said elongated member in fixed relation to said first clamping device, and (ii) a first attachment mechanism configured to removably secure said first mounting apparatus to a first support whereby the first mounting apparatus is not hard-mounted to the first support, said first attachment mechanism possessing a first configuration; and a second mounting apparatus including (i) a second clamping device configured to engage said outer surface of said elongated member so as to releasably hold said elongated member in fixed relation to said second clamping device, and (ii) a second attachment mechanism configured to removably secure said second mounting apparatus to a second support whereby the second mounting apparatus is not hard-mounted to the second support, said second attachment mechanism possessing a second configuration which is different from said first configuration, wherein said first configuration of said first attachment mechanism is characterized by said first attachment mechanism including (i) a generally C-shaped structure that defines a contact surface and an internally threaded bore that is spaced apart from said contact surface, and (ii) an externally threaded adjustment screw meshingly received within said internally threaded bore, said adjustment screw being movable in relation to said contact surface in response to rotation of said adjustment screw, and wherein said second configuration of said second attachment mechanism is characterized by said second attachment mechanism including (i) a plate that has an opening defined therein, (ii) an externally threaded fastener configured to extend through said opening, and (iii) a generally T-shaped nut having an internally threaded bore configured to meshingly receive a portion of said externally threaded fastener therein.

12. An assembly, comprising:

a vise apparatus including (i) an elongated member possessing an outer surface, (ii) a first clamping component attached to a first end portion of said elongated member, and (iii) a second clamping component defining a passage through which said elongated member extends;

a first mounting apparatus including (i) a first clamping device configured to engage said outer surface of said elongated member so as to releasably hold said elongated member in fixed relation to said first clamping device, and (ii) a first attachment mechanism configured to removably secure said first mounting apparatus to a first support whereby the first mounting apparatus is not hard-mounted to the first support, said first attachment mechanism possessing a first configuration; and a second mounting apparatus including (i) a second clamping device configured to engage said outer surface of said elongated member so as to releasably hold said elongated member in fixed relation to said second clamping device, and (ii) a second attachment mechanism configured to removably secure said second mounting apparatus to a second support whereby the second mounting apparatus is not hard-mounted to the second support, said second attachment mechanism possessing a second configuration which is different from said first configuration, wherein said first clamping component includes a locking mechanism configured to releasably secure said first clamping component to said elongated member at any one of a plurality of positions along the length of said elongated member.

13. The assembly of claim 12, wherein said second clamping component is permanently fixed in relation to said elongated member.

14. An assembly, comprising:

a vise apparatus including (i) an elongated member possessing an outer surface, (ii) a first clamping component attached to a first end portion of said elongated member, and (iii) a second clamping component defining a passage through which said elongated member extends;

a first mounting apparatus including (i) a first clamping device configured to engage said outer surface of said elongated member so as to releasably hold said elongated member in fixed relation to said first clamping device, and (ii) a first attachment mechanism configured to removably secure said first mounting apparatus to a first support whereby the first mounting apparatus is not hard-mounted to the first support, said first attachment mechanism possessing a first configuration; and a second mounting apparatus including (i) a second clamping device configured to engage said outer surface of said elongated member so as to releasably hold said elongated member in fixed relation to said second clamping device, and (ii) a second attachment mechanism configured to removably secure said second mounting apparatus to a second support whereby the second mounting apparatus is not hard-mounted to the second support, said second attachment mechanism possessing a second configuration which is different from said first configuration, wherein said first clamping device includes a first pair of jaws that cooperate with each other to form a first clamping surface that is shaped complementary to said outer surface of said elongated member, and wherein said second clamping device includes a second pair of jaws that cooperate with each other to form a second clamping surface that is shaped complementary to said outer surface of said elongated member.

15. An assembly, comprising:

a vise apparatus including (i) an elongated member possessing an outer surface, (ii) a first clamping component attached to a first end portion of said elongated member, and (iii) a second clamping component defining a passage through which said elongated member extends;

a first mounting apparatus including (i) a first clamping device configured to engage said outer surface of said elongated member so as to releasably hold said elongated member in fixed relation to said first clamping device, and (ii) a first attachment mechanism configured to removably secure said first mounting apparatus to a first support whereby the first mounting apparatus is not hard-mounted to the first support, said first attachment mechanism possessing a first configuration; and a second mounting apparatus including (i) a second clamping device configured to engage said outer surface of said elongated member so as to releasably hold said elongated member in fixed relation to said second clamping device, and (ii) a second attachment mechanism configured to removably secure said second mounting apparatus to a second support whereby the second mounting apparatus is not hard-mounted to the second support, said second attachment mechanism possessing a second configuration which is different from said first configuration, wherein said first clamping component includes a first pedestal portion having a first length and a first width, wherein said second clamping component includes a second pedestal portion having a second length and a second width, wherein said first length of said first clamping component is arranged perpendicular to said elongated member, and wherein said second length of said second clamping component is arranged perpendicular to said elongated member.

16. An assembly, comprising:

a vise apparatus including (i) an elongated member possessing an outer surface, (ii) a first clamping component attached to a first end portion of said elongated member, and (iii) a second clamping component defining a passage through which said elongated member extends;

a first mounting apparatus including (i) a first clamping device configured to engage said outer surface of said elongated member so as to releasably hold said elongated member in fixed relation to said first clamping device, and (ii) a first attachment mechanism configured to removably secure said first mounting apparatus to a first support whereby the first mounting apparatus is not hard-mounted to the first support, said first attachment mechanism possessing a first configuration; and a second mounting apparatus including (i) a second clamping device configured to engage said outer surface of said elongated member so as to releasably hold said elongated member in fixed relation to said second clamping device, and (ii) a second attachment mechanism configured to removably secure said second mounting apparatus to a second support whereby the second mounting apparatus is not hard-mounted to the second support, said second attachment mechanism possessing a second configuration which is different from said first configuration, wherein said first mounting apparatus further includes a ball and socket clamping assembly interposed between said first clamping device and said first attachment mechanism, and wherein said ball and socket clamping assembly is configured to releasably secure said first clamping device at any one of a plurality of orientations in relation to said first attachment mechanism.

17. The assembly of claim 16, wherein said second mounting apparatus further includes a pair of vertically oriented support members between which said second clamping device is located.

18. An assembly, comprising:

a vise apparatus including (i) an elongated member possessing an outer surface, (ii) a first clamping component attached to a first end portion of said elongated member, and (iii) a second clamping component defining a passage through which said elongated member extends;

a first mounting apparatus including (i) a first clamping device configured to engage said outer surface of said elongated member so as to releasably hold said elongated member in fixed relation to said first clamping device, and (ii) a first attachment mechanism configured to removably secure said first mounting apparatus to a first support whereby the first mounting apparatus is not hard-mounted to the first support, said first attachment mechanism possessing a first configuration; and a second mounting apparatus including (i) a second clamping device configured to engage said outer surface of said elongated member so as to releasably hold said elongated member in fixed relation to said second clamping device, and (ii) a second attachment mechanism configured to removably secure said second mounting apparatus to a second support whereby the second mounting apparatus is not hard-mounted to the second support, said second attachment mechanism possessing a second configuration which is different from said first configuration; and a tool holder including: (i) an eyelet defining an opening through which a tool may extend; and (ii) a post extending from said eyelet and possessing an outer surface configured with the same shape possessed by said outer surface of said elongated member.

19. An assembly, comprising:

a vise apparatus including (i) an elongated member possessing an outer surface, (ii) a first clamping component attached to a first end portion of said elongated member, and (iii) a second clamping component defining a passage through which said elongated member extends;

a first mounting apparatus including (i) a first clamping device configured to engage said outer surface of said elongated member so as to releasably hold said elongated member in fixed relation to said first clamping device, and (ii) a first attachment mechanism configured to removably secure said first mounting apparatus to a first support whereby the first mounting apparatus is not hard-mounted to the first support, said first attachment mechanism possessing a first configuration; and a second mounting apparatus including (i) a second clamping device configured to engage said outer surface of said elongated member so as to releasably hold said elongated member in fixed relation to said second clamping device, and (ii) a second attachment mechanism configured to removably secure said second mounting apparatus to a second support whereby the second mounting apparatus is not hard-mounted to the second support, said second attachment mechanism possessing a second configuration which is different from said first configuration, wherein said outer surface of said elongated member is a polygonal-shaped outer surface.

20. The assembly of claim 16, wherein said second mounting apparatus further includes a frame structure interposed between said second clamping device and said second attachment mechanism and configured to secure said second clamping device at a predetermined orientation in relation to said second attachment mechanism.

21. An assembly, comprising:

a vise apparatus including (i) a first clamping component, (ii) a second clamping component, and (iii) an elongated member possessing an outer surface, said elongated member being at least partially interposed between said first clamping component and said second clamping component;

a first mounting apparatus including (i) a first clamping device configured to engage said outer surface of said elongated member, (ii) a first attachment mechanism configured to removably secure said first mounting apparatus to a first support, and (iii) a ball and socket clamping assembly interposed between said first clamping device and said first attachment mechanism and configured to releasably secure said first clamping device at any one of a plurality of orientations in relation to said first attachment mechanism; and a second mounting apparatus including (i) a second clamping device configured to engage said outer surface of said elongated member, (ii) a second attachment mechanism configured to removably secure said second mounting apparatus to a second support, and (iii) a frame structure interposed between said second clamping device and said second attachment mechanism and configured to secure said second clamping device at a predetermined orientation in relation to said second attachment mechanism, wherein the second attachment mechanism includes at least two attachment assemblies configured to couple with the second support such that the second mounting apparatus is movable along the second support while coupled with the second support, wherein said first attachment mechanism includes (i) a generally C-shaped structure defining a contact surface and an internally threaded bore that is spaced apart from said contact surface, and (ii) an externally threaded adjustment screw meshingly received within said internally threaded bore, said adjustment screw being movable in relation to said contact surface in response to rotation of said adjustment screw;

wherein said second attachment mechanism includes a plate having a first and a second opening defined therein; and wherein each of the at least two attachment assemblies includes (i) an externally threaded fastener configured to extend through at least one of said first and second opening, and (ii) a generally T-shaped nut having an internally threaded bore configured to meshingly receive a portion of said externally threaded fastener therein.

22. An assembly, comprising:

a vise apparatus including (i) a first clamping component, (ii) a second clamping component, and (iii) an elongated member possessing an outer surface, said elongated member being at least partially interposed between said first clamping component and said second clamping component;

a first mounting apparatus including (i) a first clamping device configured to engage said outer surface of said elongated member, (ii) a first attachment mechanism configured to removably secure said first mounting apparatus to a first support, and (iii) a ball and socket clamping assembly interposed between said first clamping device and said first attachment mechanism and configured to releasably secure said first clamping device at any one of a plurality of orientations in relation to said first attachment mechanism; and a second mounting apparatus including (i) a second clamping device configured to engage said outer surface of said elongated member, (ii) a second attachment mechanism configured to removably secure said second mounting apparatus to a second support, and (iii) a frame structure interposed between said second clamping device and said second attachment mechanism and configured to secure said second clamping device at a predetermined orientation in relation to said second attachment mechanism, wherein the second attachment mechanism includes at least two attachment assemblies configured to couple with the second support such that the second mounting apparatus is movable along the second support while coupled with the second support, wherein said first clamping component includes a locking mechanism configured to releasably secure said first clamping component to said elongated member at any one of a plurality of positions along the length of said elongated member.

23. An assembly, comprising:

a vise apparatus including (i) a first clamping component, (ii) a second clamping component, and (iii) an elongated member possessing an outer surface, said elongated member being at least partially interposed between said first clamping component and said second clamping component;

a first mounting apparatus including (i) a first clamping device configured to engage said outer surface of said elongated member, (ii) a first attachment mechanism configured to removably secure said first mounting apparatus to a first support, and (iii) a ball and socket clamping assembly interposed between said first clamping device and said first attachment mechanism and configured to releasably secure said first clamping device at any one of a plurality of orientations in relation to said first attachment mechanism; and a second mounting apparatus including (i) a second clamping device configured to engage said outer surface of said elongated member, (ii) a second attachment mechanism configured to removably secure said second mounting apparatus to a second support, and (iii) a frame structure interposed between said second clamping device and said second attachment mechanism and configured to secure said second clamping device at a predetermined orientation in relation to said second attachment mechanism, wherein the second attachment mechanism includes at least two attachment assemblies configured to couple with the second support such that the second mounting apparatus is movable along the second support while coupled with the second support, wherein said first clamping device includes a first pair of jaws that cooperate with each other to form a first clamping surface that is shaped complementary to said outer surface of said elongated member, and wherein said second clamping device includes a second pair of jaws that cooperate with each other to form a second clamping surface that is shaped complementary to said outer surface of said elongated member.

24. An assembly, comprising:

a vise apparatus including (i) a first clamping component, (ii) a second clamping component, and (iii) an elongated member possessing an outer surface, said elongated member being at least partially interposed between said first clamping component and said second clamping component;

a first mounting apparatus including (i) a first clamping device configured to engage said outer surface of said elongated member, (ii) a first attachment mechanism configured to removably secure said first mounting apparatus to a first support, and (iii) a ball and socket clamping assembly interposed between said first clamping device and said first attachment mechanism and configured to releasably secure said first clamping device at any one of a plurality of orientations in relation to said first attachment mechanism; and a second mounting apparatus including (i) a second clamping device configured to engage said outer surface of said elongated member, (ii) a second attachment mechanism configured to removably secure said second mounting apparatus to a second support, and (iii) a frame structure interposed between said second clamping device and said second attachment mechanism and configured to secure said second clamping device at a predetermined orientation in relation to said second attachment mechanism, wherein the second attachment mechanism includes at least two attachment assemblies configured to couple with the second support such that the second mounting apparatus is movable along the second support while coupled with the second support, wherein said first clamping component includes a first pedestal portion having a first length and a first width, wherein said second clamping component includes a second pedestal portion having a second length and a second width, wherein said first length of said first clamping component is arranged perpendicular to said elongated member, and wherein said second length of said second clamping component is arranged perpendicular to said elongated member.

25. An assembly, comprising:

a vise apparatus including (i) a first clamping component, (ii) a second clamping component, and (iii) an elongated member possessing an outer surface, said elongated member being at least partially interposed between said first clamping component and said second clamping component;

a first mounting apparatus including (i) a first clamping device configured to engage said outer surface of said elongated member, (ii) a first attachment mechanism configured to removably secure said first mounting apparatus to a first support, and (iii) a ball and socket clamping assembly interposed between said first clamping device and said first attachment mechanism and configured to releasably secure said first clamping device at any one of a plurality of orientations in relation to said first attachment mechanism; and a second mounting apparatus including (i) a second clamping device configured to engage said outer surface of said elongated member, (ii) a second attachment mechanism configured to removably secure said second mounting apparatus to a second support, and (iii) a frame structure interposed between said second clamping device and said second attachment mechanism and configured to secure said second clamping device at a predetermined orientation in relation to said second attachment mechanism, wherein the second attachment mechanism includes at least two attachment assemblies configured to couple with the second support such that the second mounting apparatus is movable along the second support while coupled with the second support; and a tool holder including: (i) an eyelet defining an opening through which a tool may extend; and (ii) a post extending from said eyelet and possessing an outer surface configured to match the shape of said outer surface of said elongated member.

26. An assembly, comprising:

a vise apparatus including (i) a first clamping component, (ii) a second clamping component, and (iii) an elongated member possessing an outer surface, said elongated member being at least partially interposed between said first clamping component and said second clamping component;

a first mounting apparatus including (i) a first clamping device configured to engage said outer surface of said elongated member, (ii) a first attachment mechanism configured to removably secure said first mounting apparatus to a first support, and (iii) a ball and socket clamping assembly interposed between said first clamping device and said first attachment mechanism and configured to releasably secure said first clamping device at any one of a plurality of orientations in relation to said first attachment mechanism; and a second mounting apparatus including (i) a second clamping device configured to engage said outer surface of said elongated member, (ii) a second attachment mechanism configured to removably secure said second mounting apparatus to a second support, and (iii) a frame structure interposed between said second clamping device and said second attachment mechanism and configured to secure said second clamping device at a predetermined orientation in relation to said second attachment mechanism, wherein the second attachment mechanism includes at least two attachment assemblies configured to couple with the second support such that the second mounting apparatus is movable along the second support while coupled with the second support, wherein said outer surface of said elongated member is a polygonal-shaped outer surface.

27. The assembly of claim 26, wherein said polygonal-shaped outer surface of said elongated member is a rectangular-shaped outer surface.

28. The assembly of claim 21, wherein:

said first opening comprises a substantially circular bore; and said second opening comprises a slot defining an axis, the axis aligned with the first opening.

* * * * *

UNITED STATES PATENT AND TRADEMARK OFFICE

CERTIFICATE OF CORRECTION

PATENT NO. : 8,322,699 B2
APPLICATION NO. : 11/492326
DATED : December 4, 2012
INVENTOR(S) : Prell et al.

It is certified that error appears in the above-identified patent and that said Letters Patent is hereby corrected as shown below:

On the title page, item (56), col. 2 the list of References Cited should include the following:

--OTHER PUBLICATIONS

Steelex® D2482 Swivel Vise with Suction Base advertisement, downloaded January 16, 2006 from right-tool.com (3 pages).

Wilton® 60685 MULTI-GRIP™ Holding System advertisement, downloaded January 16, 2006 from right-tool.com (3 pages).

Toolstation Precision Multi-angle Vise advertisement, downloaded January 16, 2006 from toolstation.com (2 pages).

Dremel 2214 D-Vise advertisement; Publicly displayed at least as early as July 23, 2006 on dremel.com (2 pages).

Wolfcraft 3410 QUICK-JAW® 4 Position – Jaw advertisement; downloaded from wolfcraft.com (1 page).--

Signed and Sealed this
Fourteenth Day of January, 2014

Michelle K. Lee

Michelle K. Lee
*Deputy Director of the United States Patent and Trademark Office*